US008807855B2

(12) United States Patent
Suzuki

(10) Patent No.: US 8,807,855 B2
(45) Date of Patent: Aug. 19, 2014

(54) APPARATUS FOR CUTTING A MEDIUM

(75) Inventor: Nobuyoshi Suzuki, Hamamatsu (JP)

(73) Assignee: Roland DG Corporation, Hamamatsu-Shi, Shizuoka-Ken (JP)

( * ) Notice: Subject to any disclaimer, the term of this patent is extended or adjusted under 35 U.S.C. 154(b) by 332 days.

(21) Appl. No.: 13/276,260

(22) Filed: Oct. 18, 2011

(65) Prior Publication Data

US 2012/0134734 A1 May 31, 2012

(30) Foreign Application Priority Data

Nov. 29, 2010 (JP) ..... 2010-265605

(51) Int. Cl.

| | |
|---|---|
| ***B41J 11/00*** | (2006.01) |
| ***B26D 7/26*** | (2006.01) |
| ***B26F 1/38*** | (2006.01) |
| ***B41J 11/66*** | (2006.01) |

(52) U.S. Cl.

CPC ..... *B41J 11/663* (2013.01); *B26D 7/2628* (2013.01); *B26F 1/3806* (2013.01); *B26D 2007/2678* (2013.01); *B26D 2007/2685* (2013.01)

USPC ..... 400/621; 400/611

(58) Field of Classification Search

USPC ..... 400/621

See application file for complete search history.

(56) References Cited

U.S. PATENT DOCUMENTS

| | | | | |
|---|---|---|---|---|
| 6,030,135 | A * | 2/2000 | Imai | 400/621 |
| 6,260,457 | B1 * | 7/2001 | Hakkaku | 83/167 |
| 6,270,215 | B1 * | 8/2001 | Miyasaka et al. | 347/104 |
| 6,664,995 | B2 * | 12/2003 | Milton et al. | 347/218 |
| 6,742,858 | B2 * | 6/2004 | Lehmkuhl et al. | 400/621 |
| 6,807,888 | B1 * | 10/2004 | Kiyohara et al. | 83/485 |
| 7,422,386 | B2 * | 9/2008 | Ohmori et al. | 400/621 |
| 7,823,505 | B2 * | 11/2010 | Paita | 101/38.1 |
| 8,322,279 | B2 * | 12/2012 | Demange et al. | 101/38.1 |
| 2003/0156883 | A1 * | 8/2003 | Kobayashi et al. | 400/621 |
| 2008/0240834 | A1 * | 10/2008 | Takada et al. | 400/636 |

* cited by examiner

*Primary Examiner* — Anthony Nguyen

(74) *Attorney, Agent, or Firm* — Lee, Hong, Degerman, Kang & Waimey

(57) ABSTRACT

The present invention is related to a cutting head for cutting two-dimensional information out of a recording medium. The cutting head includes a motor, a tool base for retaining a first cutter, the tool base supporting the first cutter to be freely displaceable along a first axis, wherein the first cutter is displaced toward or away from a recording medium along the first axis; a fixed base for slidably supporting displacement of the tool base along the first axis; a displacing mechanism for displacing a link member along the first axis to displace the tool base along the first axis, the displacing mechanism driven by the motor; a first elastic member for coupling the link member with the tool base; and a second elastic member for coupling the tool base with the fixed base.

20 Claims, 8 Drawing Sheets

APPARATUS FOR CUTTING A MEDIUM

CROSS-REFERENCE TO RELATED APPLICATIONS

Pursuant to 35 U.S.C. §119(a), this application claims the benefit of earlier filing date and right of priority to Japanese Application No. 2010-265605, filed on Nov. 29, 2010, the contents of which are hereby incorporated by reference herein in their entirety.

FIELD OF THE INVENTION

The present invention relates to an apparatus for cutting a medium, and more particularly, for cutting a desired piece of two-dimensional information out of a sheet of recording medium.

BACKGROUND OF THE INVENTION

There have been cutting apparatuses that cut pieces of two-dimensional information out of a recording medium such as a sheet of paper. The two-dimensional information may be desired characters, marks and/or figures. Typically, such a cutting apparatus cuts out a piece of two-dimensional information by displacing a recording medium held on a platen in a predetermined transfer direction, while reciprocally moving a cutting carriage retaining a cutter for cutting the recording medium in a direction perpendicular to the transfer direction of the recording medium.

For example, a previous cutting apparatus may be a print-and-cut type cutting apparatus. The print-and-cut type cutting apparatus includes an image forming carriage equipped with a recording head for printing two-dimensional information, and a cutting head for cutting out a piece of the two-dimensional information. The print-and-cut cutting apparatus performs printing or cutting with respect to a recording medium by reciprocally displacing the recording medium held on a platen in an auxiliary scanning direction, while reciprocally displacing the image forming carriage in a main scanning direction.

However, in cutting apparatuses such as the print-and-cut cutting apparatus described above, solenoids perform reciprocal driving for contact and separation of a cutter retained by the cutting head for cutting pieces of the two-dimensional information with respect to the recording medium. As such, great variations exist in the force of which the cutter pushes the recording medium such that excessive or insufficient cutting by the cutter with respect to the recording medium occurs, which leads to reduced processing accuracy. Also, when cutting of the two-dimensional information by the cutting head is prolonged, heat is generated in the solenoids, which considerably reduces the driving force of the cutter. Consequently, the reduced processing accuracy becomes more prominent.

Accordingly, to address the problems described above, the embodiments of the present invention provide a cutting apparatus that can perform reciprocal movements of a cutter for cutting out pieces of two-dimensional information with respect to a recording medium for a lengthy amount of time, and with a stable driving force. Thus, the processing accuracy in cutting pieces of two-dimensional information out of the recording medium is improved.

SUMMARY OF THE INVENTION

The present invention is directed to a cutting apparatus for cutting a recording medium.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a cutting head for cutting two-dimensional information out of a recording medium, the cutting head comprising a motor; a tool base for retaining a first cutter, the tool base supporting the first cutter to be freely displaceable along a first axis, wherein the first cutter is displaced toward or away from a recording medium along the first axis; a fixed base for slidably supporting displacement of the tool base along the first axis; a displacing mechanism for displacing a link member along the first axis to displace the tool base along the first axis, the displacing mechanism driven by the motor; a first elastic member for coupling the link member with the tool base; and a second elastic member for coupling the tool base with the fixed base.

In one aspect of the invention, the first cutter cuts at least one piece of two-dimensional information out of the recording medium. In another aspect of the invention, the two-dimensional information comprises a character, mark or figure printed onto the recording medium. In a further aspect of the invention, the recording medium comprises a continuous rolled sheet. A second cutter may be provided for cutting the continuous rolled sheet of recording medium into separate single sheets.

In another aspect of the invention, the recording medium comprises an upper sheet on which to print the two-dimensional information and a lower sheet for separably supporting the upper sheet. The first elastic member may be a tensile coil spring having a spring constant enabling the first cutter to pierce through the upper sheet of the recording medium without piercing the lower sheet of the recording medium when the first cutter is displaced toward the recording medium along the first axis. The second elastic member may be a tensile coil spring having a spring constant enabling the tool base to be upwardly displaced away from the recording medium along the first axis.

In another embodiment of the invention, a cutting apparatus for cutting two-dimensional information out of a recording medium comprises a platen for mounting a recording medium; a grid roller for displacing the recording medium mounted on the platen along a first axis; an image forming apparatus for printing two-dimensional information on the recording medium, wherein the image forming apparatus is slidably mounted on a rail extending along a second axis; and a cutting head for cutting the two-dimensional information out of the recording medium, wherein the cutting head is slidably mounted on the rail extending along the second axis. The cutting head comprises a cutting head motor, a tool base for retaining a first cutter, the tool base supporting the first cutter to be freely displaceable along a third axis, wherein the first cutter is displaced toward or away from the recording medium along the third axis, a fixed base for slidably supporting displacement of the tool base along the third axis, a displacing mechanism for displacing a link member along the third axis to displace the tool base along the third axis, the displacing mechanism driven by the cutting head motor, a first elastic member for coupling the link member with the tool base, and a second elastic member for coupling the tool base with the fixed base.

In one aspect of the invention, the image forming apparatus comprises a plurality of ink heads for dispensing ink onto the recording medium when printing the two-dimensional information onto the recording medium. In another aspect of the invention, the cutting head slides on the rail along the second axis along with the image forming apparatus. In a further aspect of the invention, the image forming apparatus prints the two-dimensional information on the recording medium while the grid roller displaces the recording medium along the first axis. In yet another aspect of the invention, the cutting head cuts the two-dimensional information out of the recording medium while the grid roller displaces the recording medium along the first axis.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to cutting a desired piece of two-dimensional information out of a sheet of recording medium.

Figure 1:
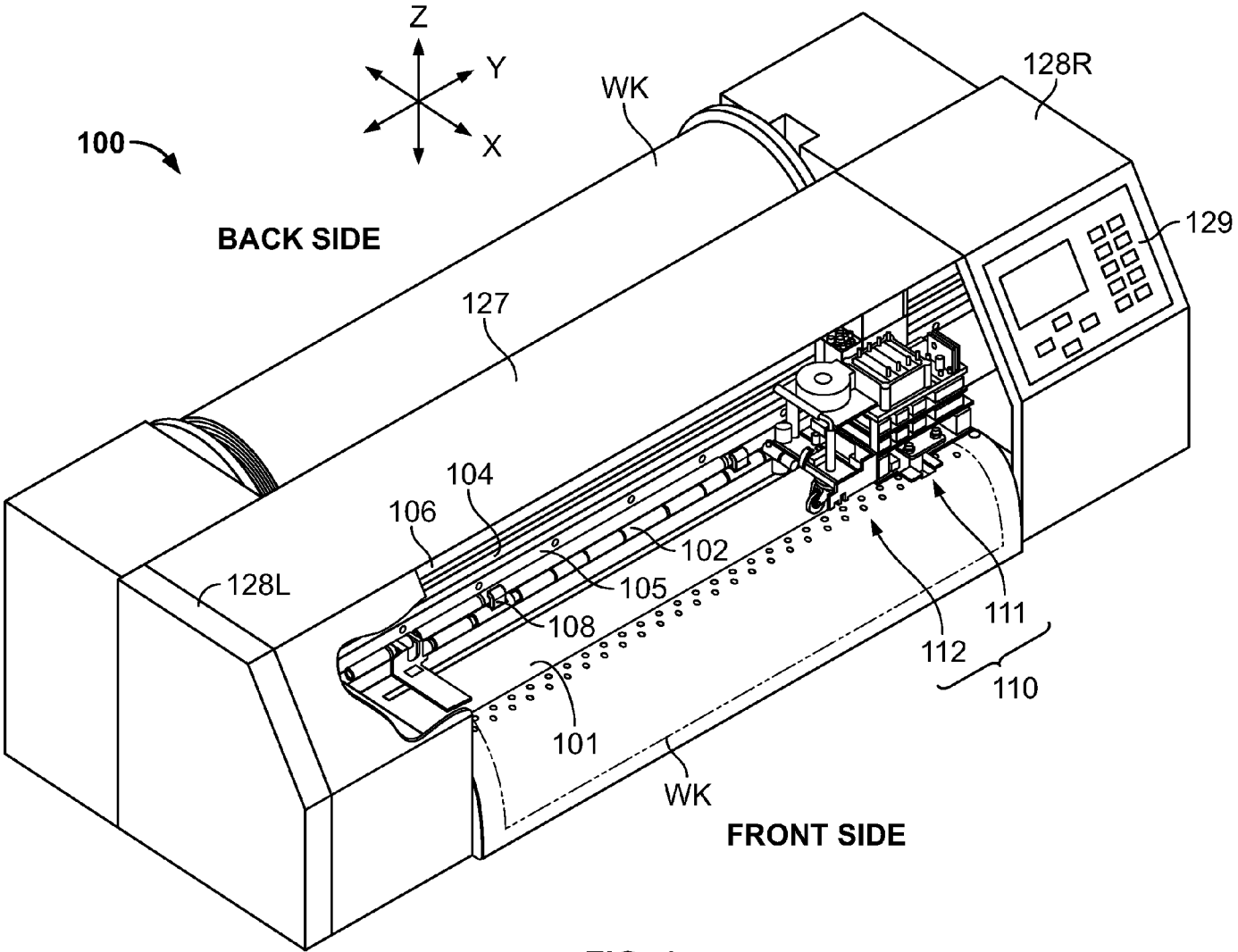
FIG. 1 is a partial cutaway external perspective view schematically showing a structure of a cutting apparatus in accordance with an embodiment of the present invention.
Figure 2:
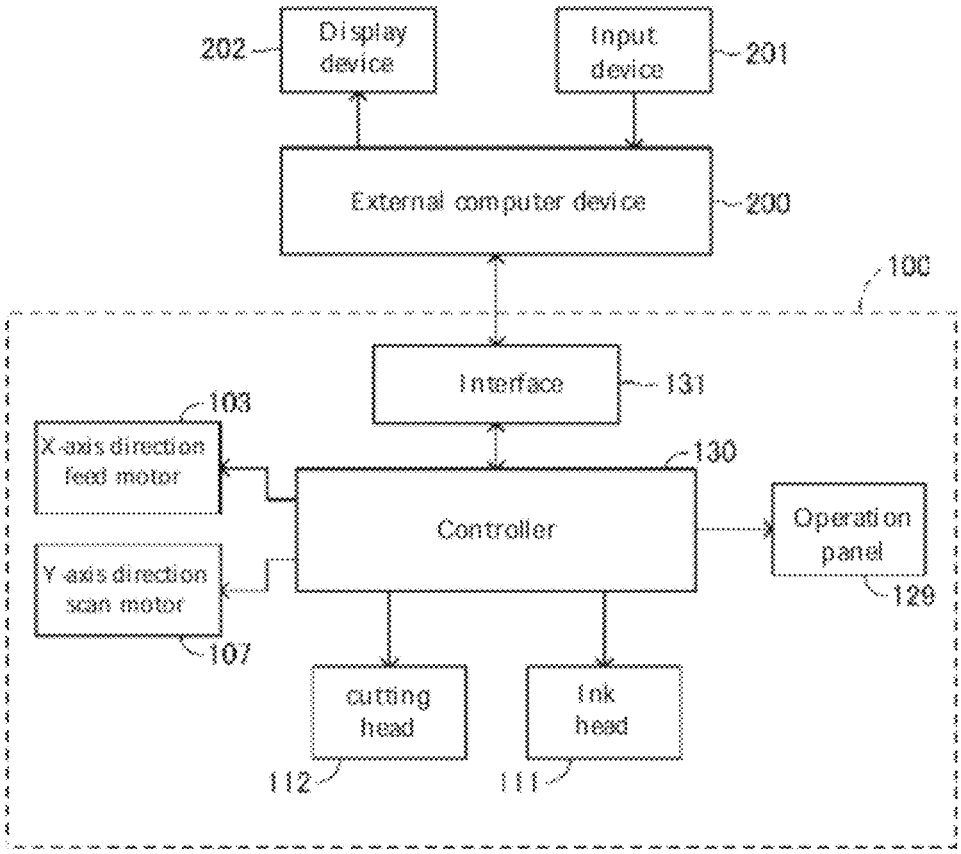
FIG. 2 is a block diagram of a control system for controlling an operation of the cutting apparatus shown in FIG. 1 in accordance with an embodiment of the present invention.

A cutting apparatus in accordance with embodiments of the present invention will be described below with reference to the accompanying drawings. FIG. 1 is a perspective view schematically showing an external appearance of a cutting apparatus 100 in accordance with an embodiment of the present invention. FIG. 2 is a block diagram of a control system for controlling an operation of the cutting apparatus 100 in accordance with an embodiment of the present invention.

It is noted that each of the figures referred to in the description of the embodiments is a schematic figure that may represent portions of the components in exaggeration to facilitate the understanding of the embodiments. Therefore, dimensions and ratios among the components may be different from those of an actual apparatus. The cutting apparatus 100 may be a print-and-cut apparatus that prints two-dimensional information on a recording medium WK by adhering ink onto the recording medium WK, and performs a cutting process to cut pieces of the two-dimensional information out of the recording medium WK using a cutter. The two-dimensional information may comprise desired characters, marks and/or figures. Also, the recording medium WK may have a rolled sheet form. In one embodiment of the present invention, the recording medium WK may be a laminate comprising two sheets, an upper sheet on which to print the two-dimensional information and a lower sheet that separably supports the upper sheet.

Referring to FIG. 1, in accordance with an embodiment, the cutting apparatus 100 includes a platen 101 having a plain section, and aprons that are curved downwardly on the front side and the back side of the plain section in the cutting apparatus 100. The platen 101 is a mounting base on which the recording medium WK is placed and supported on the plain section, and is formed extending in a left-to-right (Y-axis) direction, as shown in FIG. 1. In the plain section of the platen 101, a grid roller 102 having a cylindrical shape is provided, and extends in the Y-axis direction in a manner that its upper section is exposed. The grid roller 102 is rotatably driven by an X-axis direction feed motor 103 that is controllably driven by a controller 130 to be described below with respect to FIG. 2. It is noted that in FIG. 1, the longitudinal direction in which the platen 101 extends (Y-axis direction) is referred to as a main scanning direction, and a front-to-back direction (X-axis direction), which is orthogonal to the main scanning direction, is referred to as an auxiliary scanning direction in which the recording medium WK is transferred.

Above the platen 101, an elongated guide rail 104 is provided along the platen 101 that extends in the Y-axis direction. The guide rail 104 is an elongated member made of a rigid material, such as steel or the like, that mainly supports an image forming carriage 110. The guide rail 104 includes a linear movement rail 105 on a side surface of a front side of the cutting apparatus 100. The linear movement rail 105 is a single rail member made of a rigid material, such as steel or the like, that slidably supports the image forming carriage 110 through a linear movement block (not shown), and is affixed to the guide rail 104 along the Y-axis direction. A driving belt 106 is provided above the linear movement rail 105 along the Y-axis direction. The driving belt 106 is a circular belt that is rotationally driven by a Y-axis direction scan motor 107 (see FIG. 2). A portion of the driving belt 106 is coupled to the image forming carriage 110. Accordingly, the image forming carriage 110 is displaced in the Y-axis direction along the linear movement rail 105/guide rail 104 by the Y-axis direction scan motor 107 via the driving belt 106.

At a lower end section of the guide rail 104, four pinch rollers 108, each having a cylindrical portion, are disposed opposite to the grid roller 102 along the Y-axis direction in a moveable manner. The grid roller 102 and the pinch rollers 108 together pinch the recording medium WK having a sheet form in the up-down direction, and transfer the recording medium WK in the front-to-back direction by the rotational drive of the grid roller 102.

The image forming carriage 110 is a mechanical apparatus that forms desired two-dimensional information including characters, marks and/or figures on the recording medium WK by depositing ink on the recording medium WK, and/or by cutting pieces of two-dimensional information out of the recording medium WK with a cutter. The image forming carriage 110 is configured with ink heads 111 and a cutting head 112. The ink heads 111 are provided for a plurality of mutually different colored inks, respectively, and their operation is controlled by the controller 130. The inks are supplied to the respective ink heads 111 from corresponding ink tanks (not shown). Ink droplets of each of the inks are ejected from the ink heads 111 onto the recording medium WK. Thus, the ink heads 111 print two-dimensional information in color on the surface of the recording medium WK, wherein the colored information may comprise combinations of the plurality of mutually different colors.

Figure 3:
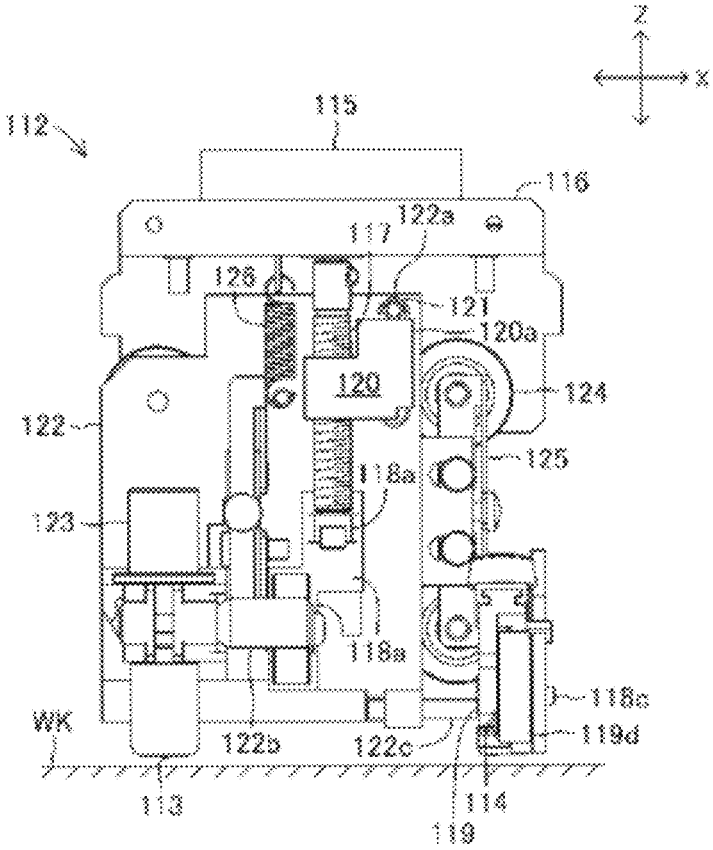
FIG. 3 is a front view schematically showing an external appearance of a cutting head used in the cutting apparatus shown in FIG. 1, wherein the cutting head is in a standby state in accordance with an embodiment of the present invention.
Figure 4:
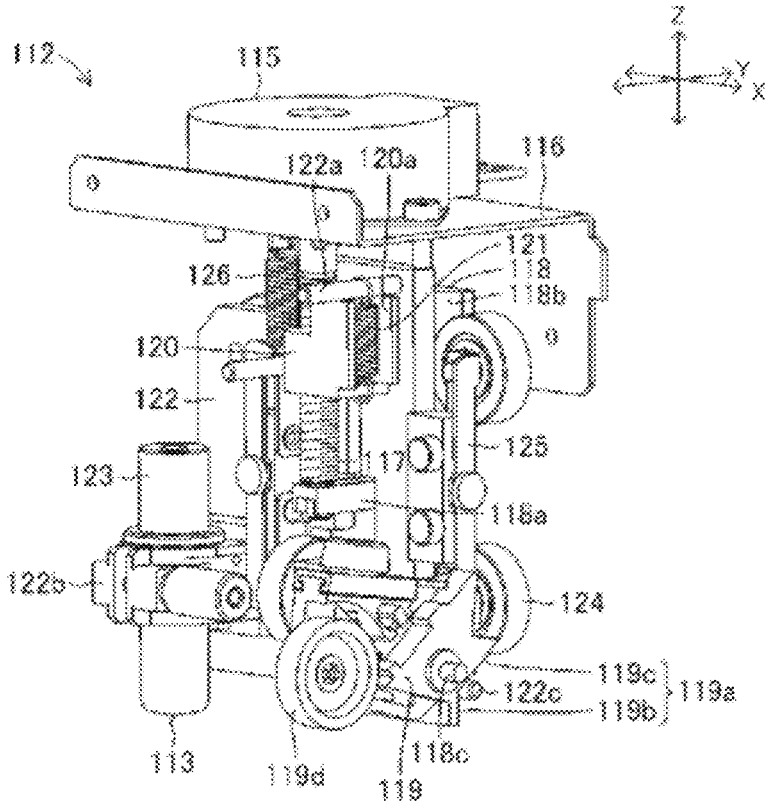
FIG. 4 is a perspective view schematically showing an external appearance of the cutting head shown in FIG. 3, wherein the cutting head is in the standby state in accordance with an embodiment of the present invention.

Referring to FIGS. 3 and 4, in an embodiment of the present invention, the cutting head 112 is a mechanical apparatus that retains two cutters, i.e., a first cutter 113 and a second cutter 114 for cutting the recording medium WK. The cutting head 112 displaces each of the cutters to contact, or move away from, the recording medium WK in a Z-axis direction (up-down direction in FIG. 1). The first cutter 113 is a cutting tool for cutting pieces of two-dimensional information out of an upper sheet of the recording medium WK, and is configured with a cutting blade formed at a tip section of a rod member. The second cutter 114 is a cutting tool for cutting the recording medium WK, which may be formed as a continuous rolled sheet, into a separate single sheet. The second cutter 114 is configured with a cutting blade formed at an edge of an elongated plate member.

The cutting head 112 is equipped with an electric motor 115. The electric motor 115 is an actuator that serves as a driving source for displacing the first cutter 113 and the second cutter 114 to contact, or move away from, the recording medium WK in the Z-axis direction. Operation of the electric motor 115 is controlled by the controller 130 (see FIG. 2). In an embodiment, the electric motor 115 is formed as a step motor. However, it is noted that the electric motor 115 may be formed as a motor other than the step motor, such as a servo motor, for example. The electric motor 115 is affixed on a rigid (e.g. steel) support stay 116 that is fixedly provided on the cutting head 112.

The electric motor 115 includes a drive shaft connected to a screw shaft 117. The screw shaft 117 is a shaft member having a male-threaded (externally threaded) surface, and extends in the Z-axis direction. One end of the screw shaft 117 is connected to the drive shaft of the electric motor 115 while another end is rotatably supported by a fixed base 118. The fixed base 118 is a rigid (e.g. steel) block body that is fixedly provided on the cutting head 112 below the support stay 116. A protruded section 118*a* is formed on the front face of the fixed base 118, and is disposed in a manner to protrude through a processing tool base 122. The screw shaft 117 is freely rotatably supported on the protruded section 118*a*. Also, guide grooves 118*b*, each having a generally V-shaped cross section (partially shown in FIG. 4), are formed respectively on a front face and both side surfaces of the fixed base 118. Furthermore, a support shaft 118*c* extending in the X-axis direction is provided in front of the fixed base 118, as shown on a right lower side of FIGS. 3 and 4.

The support shaft 118*c* is a shaft member that rotatably and slidably supports a second cutter holder 119 that retains the second cutter 114, and is supported in a manner protruding frontward of the fixed base 118. The second cutter holder 119 detachably retains the second cutter 114 in a state in which a blade tip of the second cutter 114 is exposed toward the recording medium WK. The second cutter holder 119 is formed in an elongated plate shape slightly longer than the length of the second cutter 114. More specifically, the second cutter holder 119 is formed with portions extending in mutually opposite directions about the support shaft 118*c* as a rotation center, and has one end that retains the second cutter 114 and another end formed with a bearing section 119*a*.

The bearing section 119*a* is a portion that receives a pushing force from a pushing rod 122*c* to be described below, and is formed in a bent shape comprising a vertical section 119*b* that extends in the Z-axis direction and a sloped section 119*c* that extends upwardly and diagonally from the vertical section 119*b*. Also, a rolling roller 119*d* is formed near the second cutter holder 119 for pressing down and rolling on an upper surface of the recording medium WK when the second cutter 114 cuts the recording medium WK.

The screw shaft 117 operates with a link member 120. The link member 120 is a block body made of resin and formed with female threads (internal threads) that engage with the male (external) threads of the screw shaft 117. The link member 120 moves along the axial direction of the screw shaft 117 by the rotational drive of the screw shaft 117. Accordingly, in accordance with an embodiment of the present invention, the female-threaded section of the link member 120 corresponds to a screw engagement section, and the screw shaft 117 and the link member 120 correspond to a screw feed mechanism. The link member 120 is formed with a protruded section 120*a* that protrudes on a side of the screw shaft 117 and extends in the Z-axis direction. The protruded section 120*a* is formed generally in a channel shape along the Z-axis direction, provided with a first elastic member 121 disposed therein, and connected to a lower end section of the first elastic member 121.

The first elastic member 121 is a tensile coil spring that links the link member 120 with a processing tool base 122 while extending and contracting according to displacements of the link member 120. An upper end section of the first elastic member 121 is connected to the processing tool base 122. The first elastic member 121 is provided with a spring constant set to exhibit an elastic force to the extent that the first cutter 113 is able to pierce through an upper sheet of the recording medium WK, but not into a lower sheet of the recording medium WK.

The processing tool base 122 is a plate member made of resin, for example, that supports the first cutter 113 and is displaced in the Z-axis direction. A support pin 122*a* that supports an upper end section of the first elastic member 121 is provided at a front face of the processing tool base 122 such that the support pin 122*a* is positioned above the protruded section 120*a* of the link member 120. Also, a grip-holding section 122*b* that detachably retains the first cutter 113 through a first cutter holder 123 is provided at the front of the processing tool base 122. In this case, the first cutter holder 123 is formed as a cylindrical body with a bottom section which opens to a surface of the recording medium WK, and detachably retains the first cutter 113 inserted in the cylindrical body in a manner to allow the blade tip of the first cutter 113 to be exposed through the opened bottom section, and freely rotatable about the axial line.

In front of the processing tool base 122, a pushing rod 122*c* is provided in a manner to protrude below the bearing section 119*a* of the second cutter holder 119. The processing tool base 122 is supported in a manner movable in the Z-axis direction with respect to the support stay 116 and the fixed base 118.

Rolling rollers 124 made of resin, for example, are provided on side and back surfaces of the processing tool base 122. The rolling rollers 124 are pressed against the guide grooves 118*b* in the fixed base 118 by leaf springs 125, and attached to the fixed base 118 in a freely slidable manner. Also, the processing tool base 122 is supported in a state in which it is suspended from a lower surface of the support stay 116 through a second elastic member 126 that is provided in front of the processing tool base 122.

The second elastic member 126 is a tensile coil spring that couples the processing tool base 122 with the support stay 116 while extending and contracting according to displacements of the processing tool base 122. The second elastic member 126 is provided with a spring constant to exhibit an elastic force to the extent that the second elastic member 126 can lift the processing tool base 122 that is freely and slidably supported on the fixed base 118. Accordingly, the processing tool base 122 is elastically supported respectively by the first elastic member 121 and the second elastic member 126 in the Z-axis direction in reciprocal directions. Also, the second elastic member 126 is made of a coil spring having a spring constant that is smaller than that of the first elastic member 121.

Referring back to FIG. 1, an elongated top cover 127 that forms an upper side of the housing of the cutting apparatus 100 is provided above the image forming carriage 110. Also, side covers 128R and 128L that form sides of the housing of the cutting apparatus 100 are provided respectively on both sides of the platen 101 and the top cover 127. An operation panel 129 is formed in front of the side cover 128R for providing instructions to the cutting apparatus 100 and displaying information sent from the cutting apparatus 100. It is noted that the cutting apparatus 100 is equipped with a media retaining mechanism that retains the recording medium WK in a rolled sheet form and feeds the recording medium WK onto the platen 101.

Referring to FIG. 2, the controller 130 comprises a microcomputer formed from a CPU, a ROM, a RAM and the like, and executes a control program stored in a memory device such as the ROM according to instructions from a user, or instructions from an external computer device 200 connected through an interface 131. The controller 130 controls various types of operations of the cutting apparatus 100. Particularly, the controller 130 controls operations of the X-axis direction feed motor 103, the Y-axis direction scan motor 107, the ink head 111 and the cutting head 112. The external computer device 200 may be a personal computer equipped with an input device 201 including a keyboard and a mouse, and a display device 202 made of a liquid crystal display or the like.

Operations of the cutting apparatus 100 will now be described. In the description of the operations, a process of cutting out pieces of two-dimensional information by the cutting head 112 will be described. In accordance with an embodiment of the present invention, a user/operator connects the external computer device 100 to the cutting apparatus 100 through the interface 201 and turns on the power of the external computer device 200 and the cutting-out processing apparatus 100. Subsequently, the external computer device 200 executes a predetermined control program which invokes a standby state that waits for a command input from the operator.

Also, the cutting apparatus 100 executes a predetermined control program stored in the ROM within the controller 130, thereby returning the image forming carriage 110 to an original position, and invoking a standby state that waits for an instruction from the external computer device 200. Here, the original position of the image forming carriage 110 in the X-axis direction is one of the maximum movable positions within a movable range in the main scanning direction of the image forming carriage 110 (e.g., rightmost end position in FIG. 1). Also, the original position of the image forming carriage 110 in the Z-axis direction is a position where each of the blade tips of the first cutter 113 and the second cutter 114 of the cutting head 112 is completely separated from a top surface of the recording medium WK when the link member 120 is positioned at a predetermined location slightly above an intermediate position within a displaceable range of the link member 120 in the Z-axis direction (see FIGS. 3 and 4).

The operator sets, on the platen 101, a recording medium WK formed as a rolled sheet, out of which pieces of two-dimensional information is cut. Particularly, the operator disposes the recording medium WK on the platen 101, and sets the recording medium WK to be held between the grid roller 102 and the pinch rollers 108 on the platen 101. Next, the operator operates the input device 201 of the external computer device 200 to instruct the cutting apparatus 100 to perform the process of cutting out a piece of two-dimensional information from the recording medium WK.

Here, the operator may create in advance, on the external computer device 200, image data to be processed representing the piece of two-dimensional information to be cut out from the recording medium WK. In response to instruction, the external computer device 200 generates image data for processing, which may correspond to the image data created in advance and stored in the external computer device 200, and outputs the image data to the controller 130 of the cutting apparatus 100.

Accordingly, the controller 130 of the cutting apparatus 100 controls the operation of the image forming carriage 110, i.e., the operation of the cutting head 112, while changing a relative position between the image forming carriage 110 and the recording medium WK based on the image data for processing outputted from the external computer device 200, thereby executing the process of cutting a piece of two-dimensional information out of the recording medium WK.

In accordance with an embodiment, the controller 130 controls the operation of the X-axis direction feed motor 103, thereby rotationally driving the grid roller 102 to displace the recording medium WK held on the platen 101 in the auxiliary scanning direction in the X-axis direction. The controller 130 also controls the operation of the Y-axis direction scan motor 107, thereby rotationally driving the drive belt 106 to displace the image forming carriage 110 in the main scanning direction in the Y-axis direction. Also, the controller 130 controls the operation of the cutting head 112, thereby raising or lowering the first cutter 113 with respect to the recording medium WK to perform the operation of cutting pieces of two-dimensional information out of the recording medium WK.

In the process of cutting pieces of two-dimensional information out of the recording medium WK, the controller 130 controls the operation of the electric motor 115, thereby piercing one of the first cutter 113 or the second cutter 114 into the recording medium WK or separating one of the first cutter 113 or the second cutter 114 therefrom. Particularly, when the first cutter 113 is to be pierced into the recording medium WK, the controller 130 rotationally drives the electric motor 115 in a rotational direction in which the link member 120 displaces the screw shaft 117 downwardly. Here, the controller 130 controls the rotational drive by an amount with which the blade tip of the first cutter 113 is able to move to a piercing depth just to pass through the upper sheet of the recording medium WK.

Figure 5:
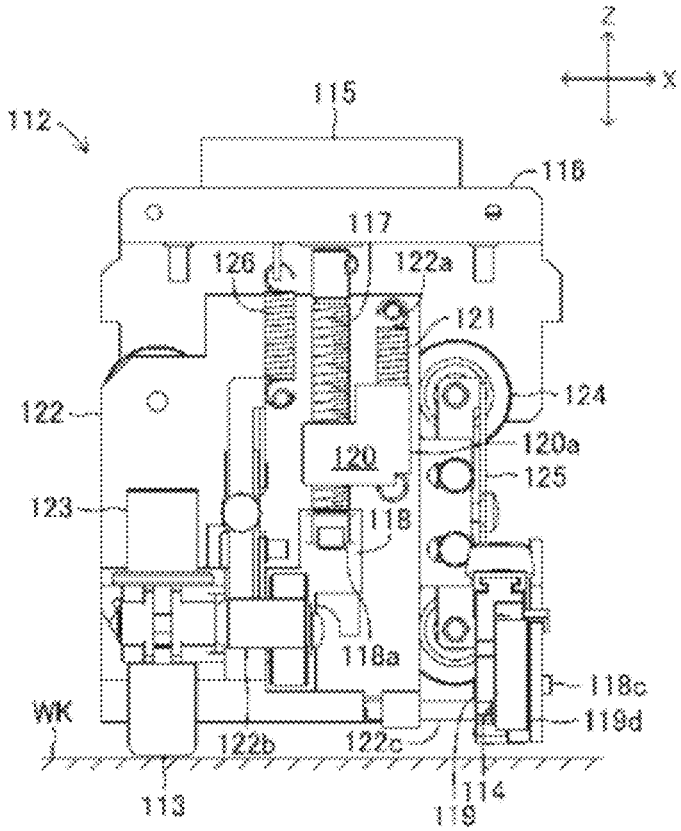
FIG. 5 is a front view schematically showing an external appearance of a cutting head used in the cutting apparatus shown in FIG. 1, wherein the cutting head is in a cut processing state in accordance with an embodiment of the present invention.
Figure 6:
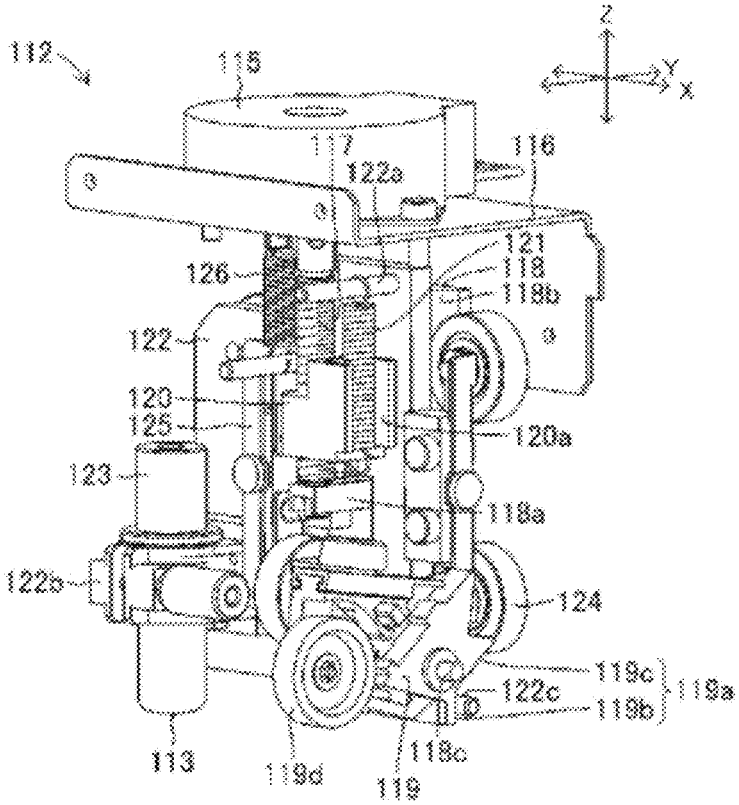
FIG. 6 is a perspective view schematically showing an external appearance of the cutting head shown in FIG. 5, wherein the cutting head is in the cut processing state in accordance with an embodiment of the present invention.

Referring to FIGS. 5 and 6, as the link member 120 is displaced downwardly along the axial line of the screw shaft 117, the processing tool base 122 linked to the link member 120 through the first elastic member 121 is displaced downwardly along the guide groove 118*a* of the fixed base 118. Here, as the processing tool base 122 is supported in a state suspended by the support stay 116 through the second elastic member 126, the first elastic member 121, while cancelling its initial tension, extends against the resilient force of the second elastic member 126 and pulls the processing tool base 122 downwardly. Thus, the first cutter 113 is lowered along with the displacement of the processing tool base 122 and is pierced into the upper sheet of the recording medium WK. Accordingly, the processing tool base 122 is pulled downward by the elastic force of the first elastic member 121, and is supported in a state pulled upward by the elastic force of the second elastic member 126.

Moreover, as the processing tool base 122 is lowered, the pushing rod 122*c* provided on the processing tool base 122 moves down along the vertical section 119*b* of the bearing section 119*a* of the second cutter holder 119. As a result, the second cutter holder 119 maintains its state of being separated from the surface of the recording medium WK as its rotational displacement is restricted due to the pushing rod 122*c* pushing the vertical section 119*b*.

In this manner, the processing tool base 122, i.e., the first cutter 113 performs the process of cutting the recording medium WK in the state in which it is elastically supported upwardly and downwardly in the Z-axis direction. For this reason, even when the piercing depth of the first cutter 113 changes during the process of cutting the recording medium WK as the balance of the force acting on the first cutter 113 changes due to undulations of the recording medium WK or the platen 101, the position of the first cutter 113 in the Z-axis direction is able to adapt to the changes. Accordingly, the cutting process can be performed while maintaining the piercing depth of the first cutter 113 with respect to the recording medium WK constant. Also, as the spring constant of the first elastic member 121 is set to a value greater than the spring constant of the second elastic member, the first cutter 113 can be positively pushed toward the recording medium WK while accurately maintaining its piercing state with respect to the recording medium WK.

Furthermore, when the first cutter 113 that pierces the recording medium WK is retracted, the controller 130 rotationally drives the electric motor 115 in a rotation direction in which the link member 120 displaces the screw shaft 117 upwardly. In this case, the controller 130 controls the rotational drive by an amount with which the blade tip of the first cutter 113 is retracted from the recording medium WK and returns the blade tip to an original position.

Moreover, the link member 120 is displaced upwardly along the axial line of the screw shaft 117 such that the first elastic member 121 contracts, and the force of the first elastic member 121 that pulls the second elastic member 126 downwardly is weakened. Therefore, the processing tool base 122 is displaced upwardly along the guide groove 118*a* of the fixed base 118 by the resilient force of the second elastic member 126. Accordingly, the first cutter 113 that pierces the recording medium WK rises, separates from the recording medium WK, and returns to the original position in the Z-axis direction. Also, the pushing rod 122*c* provided on the processing tool base 122 rises along the vertical section 119*b* of the bearing section 119*a* due to the elevation of the processing tool base 122. Thus, the second cutter holder 119 maintains its state of being separated from the surface of the recording medium WK due to its rotational displacement being restricted when the state of the pushing rod 122*c* pushing the vertical section 119*b* is maintained.

The controller 130 repeatedly executes the up and down operations of the first cutter 113, thereby performing the process of cutting pieces of two-dimensional information out of the upper sheet of the recording medium WK. Then, when the process of cutting the pieces of two-dimensional information out of the recording medium WK is completed, the controller 130 feeds the recording medium WK in the auxiliary scanning direction and executes the process of cutting and separating a segment of the recording medium WK on which the cutting process has been applied.

More specifically, the controller 130 controls to rotationally drive the electric motor 115 in a rotational direction in which the link member 120 displaces the screw shaft 117 upwardly. In this case, the controller 130 controls the rotational drive by an amount with which the blade tip of the second cutter 114 reaches a piercing depth that completely passes through the recording medium WK.

Figure 7:
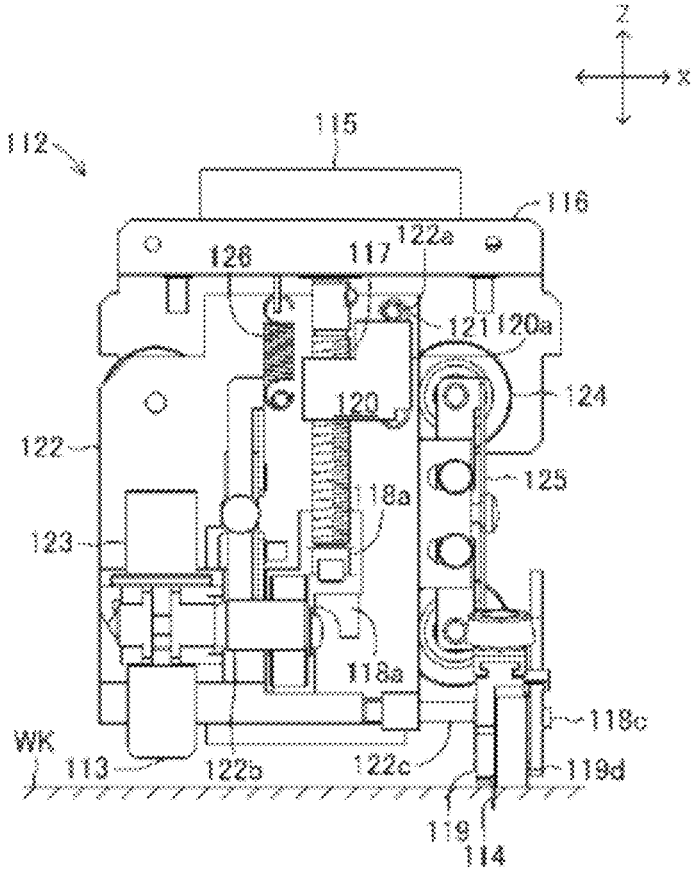
FIG. 7 is a front view schematically showing an external appearance of a cutting head used in the cutting apparatus shown in FIG. 1, wherein the cutting head is in a cut and shear processing state in accordance with an embodiment of the present invention.
Figure 8:
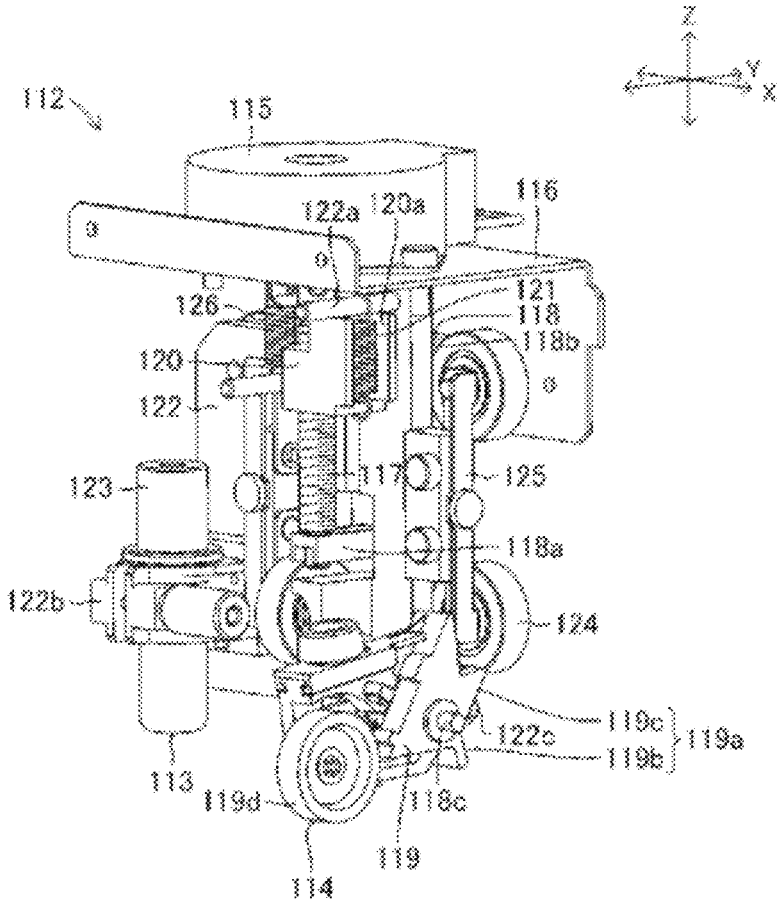
FIG. 8 is a perspective view schematically showing an external appearance of the cutting head shown in FIG. 7, wherein the cutting head is in the cut and shear processing state in accordance with an embodiment of the present invention.

Referring to FIGS. 7 and 8, as the link member 120 is displaced upwardly along the axial line of the screw shaft 117, the first elastic member 121 and the second elastic member 126 completely contract, and the upper surface of the protruded section 120*a* of the link member 120 pushes upwardly the support pin 122*a* of the processing tool base 122. Therefore, the processing tool base 122 further moves upwardly along the guide groove 118*a* of the fixed base 118 such that the pushing rod 122*c* pushes up the sloped section 119*c* of the bearing section 119*a* of the second cutter holder 119. As a result, the second cutter holder 119 is lowered on the side that retains the second cutter 114 about the support shaft 118*c*, such that the second cutter 114 cuts the recording medium WK. Also, at the same time when the second cutter 114 cuts the recording medium WK, the rolling roller 119*d* pushes the upper surface of the recording medium WK.

The controller 130 controls the operation of the Y-axis direction scan motor 107 when the second cutter 114 cuts the recording medium WK, thereby rotationally driving the drive belt 106. Accordingly, the cutting head 112 of image forming carriage 110 is displaced in the main scanning direction in the Y-axis direction. Consequently, the second cutter 114 cuts and separates the recording medium WK that is pushed down by the rolling roller 119*d*. It is noted that in the state in which the second cutter 114 pierces the recording medium WK, the first cutter 113 does not contact or cut the recording medium WK because the processing tool base 122 is at an uppermost displaced position in the Z-axis direction.

Furthermore, when the second cutter 114 that cuts the recording medium WK is retracted, the controller 130 controls to rotationally drive the electric motor 115 in a rotation direction in which the link member 120 displaces the screw shaft 117 downwardly. In this case, the controller 130 controls the rotational operation by an amount with which the blade tip of the second cutter 114 is retracted from the recording medium WK and returns the blade tip to an original position.

Moreover, as the link member 120 is displaced downwardly along the axial line of the screw shaft 117, the processing tool base 122 moves downward by its own weight along the guide groove 118*a* of the fixed base 118 along with the displacement of the link member 120. Therefore, the pushing rod 122*c* provided on the processing tool base 122 is brought to push the vertical section 119*b* instead of the sloped section 119*c* of the bearing section 119*a*. As a result, the second cutter holder 119 rises on the side that retains the second cutter 114 about the support shaft 118*c* as a rotational center, such that the second cutter 114 is separated from the recording medium WK.

When the link member 120 is further displaced downwardly along the axial line of the screw shaft 117, the processing tool base 122 assumes a state in which it is elastically suspended by the second elastic member 126 as the upper surface of the protruded section 120*a* separates from the lower side of the support pin 122*a* of the processing tool base 122. At the same time, the second cutter 114 that pierces the recording medium WK further rises and returns to the original position in the Z-axis direction.

In accordance with an embodiment of the present invention, in the cutting apparatus 100, the processing tool base 122 that retains the first cutter 113 for cutting the recording medium WK is reciprocally driven by the electric motor 115 in the Z-axis direction in which the first cutter 113 is brought in contact with, and separated from, the recording medium WK. In this case, the processing tool base 122 is coupled through the first elastic member 121 to the link member 120 that is displaced in the Z-axis direction by the electric motor 115, and is coupled through the second elastic member 126 to the fixed base 118 whose displacement in the Z-axis direction is fixed.

Accordingly, the processing tool base 122 that retains the first cutter 113 is displaced in the Z-axis direction by the electric motor 115 in a state in which it is elastically supported in reciprocal directions in the Z-axis direction by the first elastic member 121 and the second elastic member 126, respectively. Consequently, the first cutter 113 for cutting the recording medium WK can be accurately positioned in the Z-axis direction by the drive control of the electric motor 115, and is pressed against the recording medium WK with a stable force created by the elastic force of the first elastic member 121 and the second elastic member 126.

Also, even when the force applied to the first cutter 113 in the Z-axis direction changes due to undulations of the recording medium WK or the platen 101, while the recording medium WK is being cut, the cutting can still be accomplished because the elastic force of the first elastic member 121 and the second elastic member 126 allows the position of the first cutter 113 to follow such changes. Accordingly, excessive cutting or insufficient cutting by the first cutter 113 with respect to the recording medium WK can be suppressed, and the first cutter 113 can be stably pierced through the recording medium WK for a lengthy period time, such that the processing accuracy in cutting out pieces of two-dimensional information is improved.

It is noted that embodiments of the present invention are not limited to the embodiments described above. Various changes can be made to the described embodiments without departing from the scope of the invention.

For example, in an embodiment described above, the displacement mechanism for displacing the link member 120 in the Z-axis direction is formed from the screw shaft 117 and the female threads (screw engagement section) formed in the link member 120. However, the displacement mechanism is not necessarily limited to the embodiment described above, as long as the mechanism can displace the link member 120 in the Z-axis direction. For example, the displacement mechanism may be formed from a belt transmission mechanism in which pulleys are provided on the electric motor 115 and the protruded section 118*a* of the fixed base 118, and a belt having the link member 120 attached thereto between the pulleys is wound on the pulleys. Also, the displacement mechanism can be formed from a rack-and-pinion mechanism.

In accordance with an embodiment described above, the first elastic member 121 and the second elastic member 126 comprise tensile coil springs, respectively. However, the first elastic member 121 and the second elastic member 126 are not necessarily limited to the embodiment described above, as long as the link member 120 and the processing tool base 122, as well as the fixed base 118 and the processing tool base 122 are elastically coupled together, respectively. For example, the first elastic member 121 and the second elastic member 126 may comprise compression springs, leaf springs, rubber strings or the like.

In accordance with an embodiment described above, the spring constant of the first elastic member 121 is set to be greater than the spring constant of the second elastic member 126. By this setting, the first cutter 113 can be more accurately pressed against the recording medium WK. However, the spring constant of the first elastic member 121 may be set to be equal to or less than the spring constant of the second elastic member 126, wherein the first cutter 113 may still cut the recording medium WK.

In accordance with an embodiment described above, the first cutter 113 comprises a cutter that cuts a piece of two-dimensional information out of the upper sheet of the recording medium WK, and the second cutter 114 comprises a cutter that cuts and separates the recording medium WK into single sheets. However, the first cutter 113 and the second cutter 114 are not limited to the described embodiment, as long as cutters necessary for cutting the recording medium WK are used. For example, the first cutter 113 may comprise a cutter for cutting and separating the recording medium WK into single sheets, and the second cutter 114 may comprise a cutter that cuts a piece of two-dimensional information out of the upper sheet of the recording medium WK.

In accordance with an embodiment described above, the cutting head 112 is configured to be equipped with the first cutter 113 and the second cutter 114. However, the cutting head 112 may be equipped with the first cutter 113, and the second cutter 114 and the mechanism for retaining and displacing the second cutter 114, such as the support shaft 118*c*, the second cutter holder 119 and the pushing rod 122*c*, may not be provided necessarily.

In accordance with an embodiment described above, the processing tool base 122 is supported on the fixed base 118 in a state slidable in the Z-axis direction via pressing the rolling roller 124 to the guide groove 118*b* of the fixed base 118 by the leaf spring 125. Thus, the guide mechanism is configured with the guide groove 118*b* which corresponds to a guide member comprising a slidable movement support section in accordance with the embodiment. Moreover, the rolling roller 124 that is pressed by the leaf spring 125 corresponds to a follower member in accordance with the embodiment.

However, the guide mechanism is not necessarily limited to the embodiment described above, as long as it is equipped with the guide member and the follower member, and is configured to be able to guide the processing tool base 122 in the Z-axis direction. For example, the guide member may be formed from a shaft member extending in the Z-axis direction, and the follower member may be formed from a cylindrical member (bushing) that slidably moves on the shaft member. In this case, the shaft member may not necessarily be provided on the fixed base 118, but may be fixedly disposed with respect to the processing tool base 122. In other words, the fixed section may include any and all members whose displacement in the Z-axis direction is fixed so as to be incapable of displacement with respect to the processing tool base 122 that is displaced in the Z-axis direction. Therefore, the fixed base 118 and the support stay 116 may correspond to the fixed section in accordance with another embodiment of the invention. Also, when the guide mechanism for the processing tool base 122 is not necessary, the cutting head 112 may be configured with the guide mechanism omitted.

In accordance with an embodiment described above, the image forming carriage 110 is configured with the ink head 111 that prints two-dimensional information on the recording medium WK, and the cutting head 112 that cuts out pieces of two-dimensional information. However, the image forming carriage 110 is not necessarily limited to the embodiment described above, as long as it is configured to form pieces of two-dimensional information by a cutting process while being displaced with respect to the recording medium WK. In other words, the image forming carriage 110 may be configured with only at least the cutting head 112 without the ink head 111.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A cutting head for cutting two-dimensional information out of a recording medium, the cutting head comprising:

a motor;

a tool base for retaining and supporting a first cutter such that the first cutter is freely displaceable toward or away from the recording medium along a first axis;

a fixed base for slidably supporting displacement of the tool base along the first axis;

a displacing mechanism driven by the motor for displacing a link member along the first axis in order to displace the tool base along the first axis;

a first elastic member for coupling the link member with the tool base; and a second elastic member for coupling the tool base with the fixed base, wherein the second elastic member is a tensile coil spring having a spring constant enabling the tool base to be upwardly displaced away from the recording medium along the first axis.

2. The cutting head of claim 1, wherein the first cutter cuts at least one piece of two-dimensional information out of the recording medium.

3. The cutting head of claim 1, wherein the two-dimensional information comprises a character, mark or figure printed onto the recording medium.

4. The cutting head of claim 1, wherein the recording medium comprises a continuous rolled sheet.

5. The cutting head of claim 4, further comprising a second cutter for cutting the continuous rolled sheet into separate single sheets.

6. The cutting head of claim 5, wherein the first elastic member is further for controlling an elastic force applied to the first cutter in order to control the extent to which the first cutter pierces the recording medium.

7. The cutting head of claim 6, wherein the first elastic member comprises a tensile coil spring having a spring constant for enabling the first cutter to pierce through the recording medium to a specific extent when the first cutter is displaced toward the recording medium along the first axis.

8. A cutting apparatus for cutting two-dimensional information out of a recording medium, the cutting apparatus comprising:

a platen for mounting the recording medium;

a grid roller for displacing the recording medium along a first axis;

an image forming apparatus slidably mounted on a rail extending along a second axis for printing two-dimensional information on the recording medium;

a cutting head slidably mounted on the rail for cutting the two-dimensional information out of the recording medium, wherein the cutting head comprises:

a cutting head motor;

a tool base for retaining and supporting a first cutter such that the first cutter is freely displaceable toward or away from the recording medium along a third axis;

a fixed base for slidably supporting displacement of the tool base along the third axis;

a displacing mechanism driven by the cutting head motor for displacing a link member along the third axis in order to displace the tool base along the third axis;

a first elastic member for coupling the link member with the tool base; and a second elastic member for coupling the tool base with the fixed base, wherein the second elastic member is a tensile coil spring having a spring constant enabling the tool base to be upwardly displaced away from the recording medium along the third axis.

9. The cutting apparatus of claim 8, wherein the first cutter cuts at least one piece of the two-dimensional information out of the recording medium.

10. The cutting apparatus of claim 8, wherein the two-dimensional information comprises a character, mark or figure printed onto the recording medium.

11. The cutting apparatus of claim 8, wherein the recording medium comprises a continuous rolled sheet.

12. The cutting apparatus of claim 11, further comprising a second cutter for cutting the continuous rolled sheet into separate single sheets.

13. The cutting apparatus of claim 12, wherein the first elastic member is further for controlling an elastic force applied to the first cutter in order to control the extent to which the first cutter pierces the recording medium.

14. The cutting apparatus of claim 13, wherein the first elastic member comprises a tensile coil spring having a spring constant for enabling the first cutter to pierce through the recording medium to a specific extent when the first cutter is displaced toward the recording medium along the third axis.

15. The cutting apparatus of claim 8, wherein the image forming apparatus comprises a plurality of ink heads for dispensing ink onto the recording medium when printing the two-dimensional information onto the recording medium.

16. The cutting apparatus of claim 8, wherein the cutting head slides on the rail along the second axis along with the image forming apparatus.

17. The cutting apparatus of claim 8, wherein the image forming apparatus prints the two-dimensional information on the recording medium while the grid roller displaces the recording medium along the first axis.

18. The cutting apparatus of claim 8, wherein the cutting head cuts the two-dimensional information out of the recording medium while the grid roller displaces the recording medium along the first axis.

19. The cutting head of claim 1, wherein the cutting head slides on a rail along a second axis along with an image forming apparatus.

20. The cutting head of claim 1, wherein the cutting head cuts the two-dimensional information out of the recording medium while a grid roller displaces the recording medium along the first axis.

* * * * *